US007756282B2

(12) United States Patent
Rass et al.

(10) Patent No.: US 7,756,282 B2
(45) Date of Patent: Jul. 13, 2010

(54) HEARING AID EMPLOYING ELECTRET AND SILICON MICROPHONES

(75) Inventors: Uwe Rass, Nürnberg (DE); Christian Weistenhöfer, Bubenreuth (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1000 days.

(21) Appl. No.: 11/073,044

(22) Filed: Mar. 3, 2005

(65) Prior Publication Data

US 2005/0196001 A1 Sep. 8, 2005

(30) Foreign Application Priority Data

Mar. 5, 2004 (DE) ..... 10 2004 010 863

(51) Int. Cl.
*H04R 25/00* (2006.01)

(52) U.S. Cl. ..... 381/313; 381/170; 381/356

(58) Field of Classification Search ..... 381/92, 381/94.1, 99, 103, 312, 313, 317
See application file for complete search history.

(56) References Cited

U.S. PATENT DOCUMENTS 3,458,668 A * 7/1969 Hassler ..... 381/313
5,715,319 A * 2/1998 Chu ..... 381/313
6,069,963 A * 5/2000 Martin et al. ..... 381/313
6,870,939 B2 * 3/2005 Chiang et al. ..... 381/175
2004/0101153 A1 * 5/2004 Grudin et al. ..... 381/357

FOREIGN PATENT DOCUMENTS

DE 103 16 287 7/2004
WO WO 0187009 A2 * 11/2001

OTHER PUBLICATIONS

Three-Microphone Instrument is Designed to Extend Benefits of Directionality, Powers et al, The Hearing Journal, vol. 55, No. 10 (Oct. 2002) pp. 38-45.

* cited by examiner

*Primary Examiner*—Walter F Briney, III
(74) *Attorney, Agent, or Firm*—Schiff Hardin LLP

(57) ABSTRACT

In a hearing device with multiple microphones, and a signal generation method, the dynamic range of hearing devices is improved by using a combination including a silicon microphone and an electret microphone for the hearing device input. Low frequencies thus can be acquired by the silicon microphone and high frequencies can be acquired by the electret microphone, in order to generate a wide-band hearing device input signal. The fact that a silicon microphone possesses a lower internal noise than a conventional electret microphone at low frequencies is utilized.

5 Claims, 1 Drawing Sheet

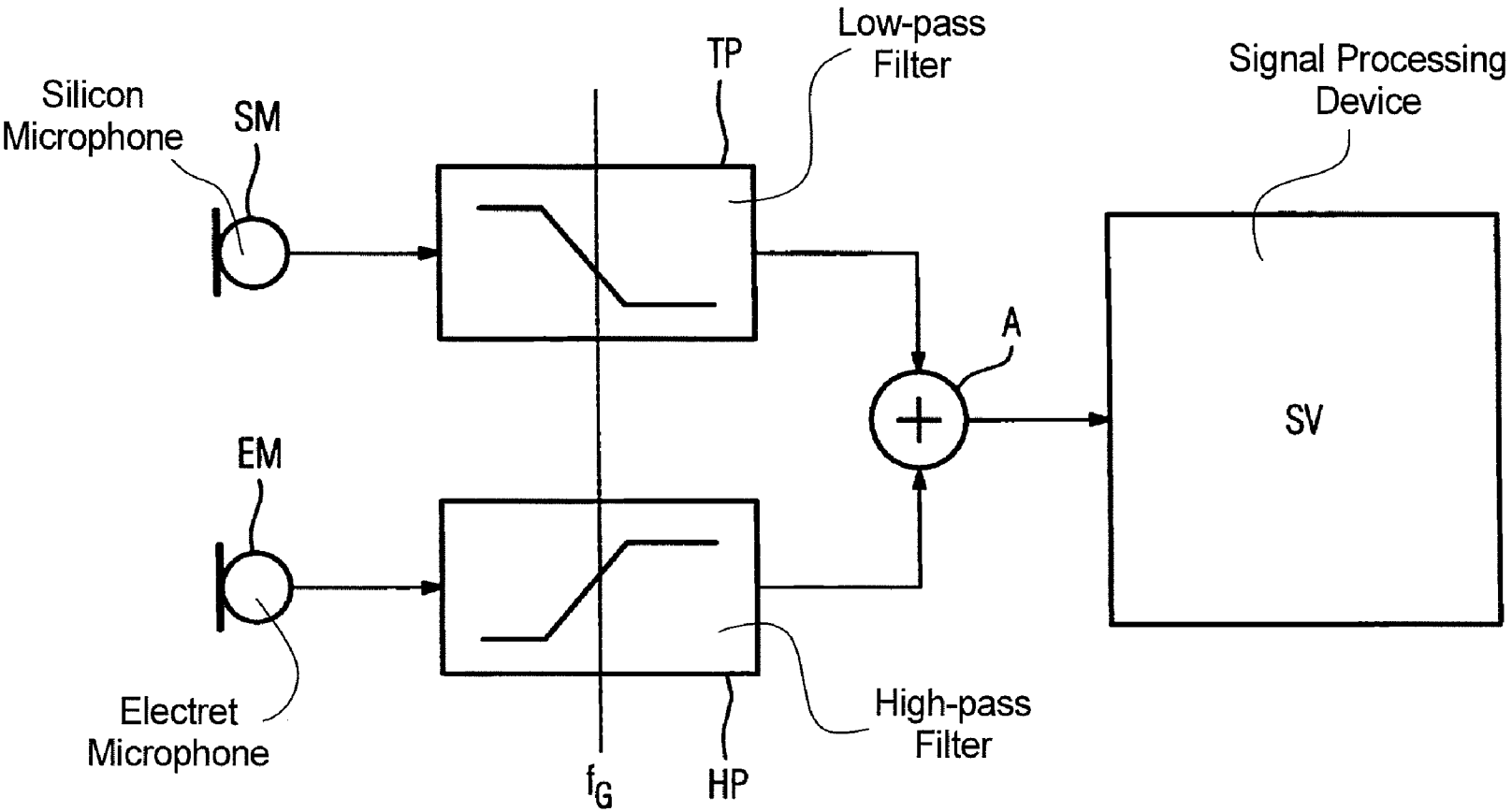
Signal Processing Device
SV
A
Low-pass Filter
TP
High-pass Filter
HP
$f_G$
SM
Silicon Microphone
EM
Electret Microphone

HEARING AID EMPLOYING ELECTRET AND SILICON MICROPHONES

BACKGROUND OF THE INVENTION

1. Field of the Invention

The present invention concerns a hearing device of the type having a first microphone that delivers a first microphone signal, a second microphone that delivers a second microphone signal, and a signal processing device to generate a hearing device output signal from the first microphone signal and the second microphone signal. The present invention also concerns a corresponding method for generating a hearing device output signal.

2. Description of the Prior Art and Related Subject Matter

The internal (quantum) noise of the microphones in hearing devices limits the dynamic range, in particular when differential directional microphonal algorithms are used. These algorithms have the result that the noise of the microphones is notably boosted at low frequencies. The higher the selected order of the directional microphone, the more serious this effect because (as is known) the transfer function of a directional microphone of the second order with three microphones drops at low frequencies faster than the transfer function of a directional microphone of the first order with two microphones. Given a directional microphone of the second order, the low frequencies consequently must be more emphasized than the low frequencies in a directional microphone of the first order, such that the signal-to-noise ratio at low frequencies is disadvantageous for a directional microphone of the second order.

Heretofore, the directional effect for low frequencies has been limited, as described, for example in "Three microphone instrument is designed to extend benefits of directionality", The Hearing Journal, October 2002, vol. 55, nr. 10, pages 38 through 45. Below a specific limit frequency, only a directional microphone of the first order is used, and for high frequencies a directional microphone of the second order is used.

The damping of the interfering signals that do not originate from the preferred direction is also less for low frequencies. In order to reduce the noise for the hearing device user, given quiet input levels the directional effect is therefore completely removed, such that the noise caused by one directional microphone ceases to exist. In this case, the microphone characteristic corresponds to an omnidirectional microphone.

A directional microphone system for hearing devices is known from the German Patent 103 16 287. Such a microphone system can be based on silicon micro-mechanisms. An electret capacitor microphone could alternatively be used.

SUMMARY OF THE INVENTION

An object of the present invention is to provide a hearing device having a directional effect in the low-frequency range with reduced noise, and as well as to provide a corresponding method to generate a hearing device output signal.

This object is inventively achieved by a hearing device with a first microphone device that delivers a first microphone signal, a second microphone device that delivers a second microphone signal, and a signal processing device that generates a hearing device output signal, wherein the first microphone device comprises an electret microphone and the second microphone device comprises a silicon microphone.

The advantageous noise ratio of the silicon microphone at low frequencies allows a better directional effect (higher directivity index) with the same noise. Expressed otherwise, it leads to a lower noise with the same directional effect. The signal quality at higher frequencies is not influenced because the conventional electret microphone is used for signal acquisition in this range.

In an embodiment of the inventive hearing device, the output of the first microphone is high-pass filtered, preferably by a high-pass filter connected immediately downstream. The microphone noise of the electret microphone at low frequencies is suppressed in this manner.

In another embodiment, the output of the second microphone device is low-pass filtered, preferably by a low-pass filter connected immediately downstream of the second microphone device. The less-positive transfer characteristic of the silicon microphone is thereby masked or suppressed.

The signal-processing device can include an adder with which the (possibly filtered) microphone signals are added. Both microphone signals can be combined in a relatively simple manner in this manner. Moreover, the signal processing device for the first microphone signal and the second microphone signal can include analog-to-digital converters respectively for the two microphone signals such that both microphone signals can be digitally combined with one another. The advantages of digital signal processing thus can be used.

In a preferred embodiment, the first microphone device comprises at least two electret microphones. Directional microphones of the first order with two electret microphones, directional microphones of the second order with three electret microphones, etc. can thus be realized for the higher-pitch (treble) range.

The second microphone device can comprise at least two silicon microphones in the same manner. Directional microphones of the first order, second order etc. can therewith be realized for the lower-pitch (bass) range.

DESCRIPTION OF THE DRAWING

The single FIGURE is a circuit diagram of an inventive hearing device.

DESCRIPTION OF THE PREFERRED EMBODIMENTS

The exemplary embodiments described in the following represent preferred embodiments of the present invention.

The basic signal input components of an inventive hearing device are drawn in the FIGURE. The hearing device has a silicon microphone SM and an electret microphone EM. The output signal of the silicon microphone SM is supplied to a low-pass filter TP. The output signal of the electret microphone EM is delivered on its end into a high-pass filter HP. The limit frequency $f_G$ of both filters TP and HP is selected approximately equally high, such that in a first approximation a transfer function designed flat for both filters mutually results in the sum. Both output signals of the filters TP and HP are added in an adder A. The sum signal of the adder A is supplied to the further hearing device signal processing SV.

With this design, the fact is utilized that silicon microphones possess a low internal noise at low frequencies but they perform worse than conventional electret microphones at higher frequencies. The combination of the two microphone types enables the low frequencies to be acquired by the silicon microphone SM and the high frequencies to be acquired by the electret microphone in order to generate a wide-band hearing device input signal for the signal processing SV. The combination can analogously ensue in the form of a diplexer or can be realized digitally. Corresponding analog-digital converters are additionally necessary for digital signal processing.

In order to realize a directional microphone of the first or second order, two or three such combined silicon-electret microphones, respectively including high-pass and low-pass filters as well as adders, are necessary.

Although modifications and changes may be suggested by those skilled in the art, it is the intention of the inventors to embody within the patent warranted hereon all changes and modifications as reasonably and properly come within the scope of their contribution to the art.

We claim as our invention:

1. A hearing device comprising:

a first microphone device, comprised of at least two electret microphones, that delivers first microphone signals, transduced from incoming audio signals, respectively from said at least two electret microphones;

a second microphone device, comprised of at least two silicon micro-mechanical microphones, that delivers second microphone signals, also transduced from incoming audio signals, with a moving component, respectively from said at least two silicon microphones;

said first and second microphone devices respectively differently transducing said incoming audio signals, due to said first microphone device comprising at least two electret microphones and due to said second microphone device comprising at least two silicon microphones; and a signal processing device that generates a hearing device output signal having a directional characteristic from said first microphone signals and said second microphone signals.

2. A hearing device as claimed in claim 1 comprising a high pass filter connected immediately downstream from said first microphone device.

3. A hearing device as claimed in claim 1 comprising a low pass filter connected immediately downstream from said second microphone device.

4. A hearing device as claimed in claim 1 wherein said signal processing device comprises an adder for adding said first microphone signals and said second microphone signals.

5. A hearing device as claimed in claim 1 wherein said signal processing device comprises a first analog-to-digital converter to which said first microphone signals are supplied, that emits first digital signals, and a second analog-to-digital converter to which said second microphone signals are supplied, that emits second digital signals, and wherein said signal processing device combines said first digital signals and said second digital signals to produce said hearing device output signal having said directional characteristic.

* * * * *